US005479990A

United States Patent [19]

Peppel

[11] Patent Number: 5,479,990

[45] Date of Patent: Jan. 2, 1996

[54] RISING CENTRALIZING SPIDER

[75] Inventor: George W. Peppel, Argyle, Tex.

[73] Assignee: Shell Oil Company, Houston, Tex.

[21] Appl. No.: 440,813

[22] Filed: May 15, 1995

Related U.S. Application Data

[63] Continuation of Ser. No. 252,143, Jun. 1, 1994, abandoned, which is a continuation of Ser. No. 952,232, Sep. 28, 1992, abandoned.

[51] Int. Cl.[6] ..... E21B 19/09

[52] U.S. Cl. ..... 166/350; 166/367; 175/10; 405/224.4; 441/133

[58] Field of Search ..... 166/350, 359, 166/367; 175/5, 7, 10; 441/5, 133; 405/224.4, 168.1

[56] References Cited

U.S. PATENT DOCUMENTS

| | | | |
|---|---|---|---|
| 3,142,343 | 7/1964 | Otteman et al. | 175/7 |
| 3,503,460 | 3/1970 | Gadbois | 175/5 |
| 3,528,497 | 9/1970 | Lehman . | |
| 3,601,075 | 8/1971 | Deslierres | 175/7 X |
| 4,423,983 | 1/1984 | Dadiras et al. | 166/350 X |
| 4,432,420 | 2/1984 | Gregory et al. | 175/5 X |
| 4,576,516 | 3/1986 | Denison | 405/224.4 |
| 4,616,707 | 10/1986 | Langner | 166/345 |
| 4,616,708 | 10/1986 | Da Mota | 175/7 X |
| 4,617,998 | 10/1986 | Langner | 166/345 |
| 4,733,991 | 3/1988 | Myers | 175/7 X |
| 4,787,778 | 11/1988 | Myers et al. | 166/367 X |
| 4,883,387 | 11/1989 | Myers et al. | 175/5 X |
| 5,148,871 | 9/1992 | Gullion | 166/359 X |
| 5,160,219 | 11/1992 | Arlt | 405/224.4 X |

FOREIGN PATENT DOCUMENTS

| | | | |
|---|---|---|---|
| 2080861 | 2/1982 | United Kingdom | 405/224.4 |

*Primary Examiner*—Roger J. Schoeppel

[57] ABSTRACT

A mechanical device for centralizing a subsea riser in an opening in a floating drilling vessel. The centralizing device includes at least three arms that are pivotally connected at one end to the vessel and pivotally connected at the other end to a rotating collar with the riser extruding through the collar.

7 Claims, 3 Drawing Sheets

FIG. 2
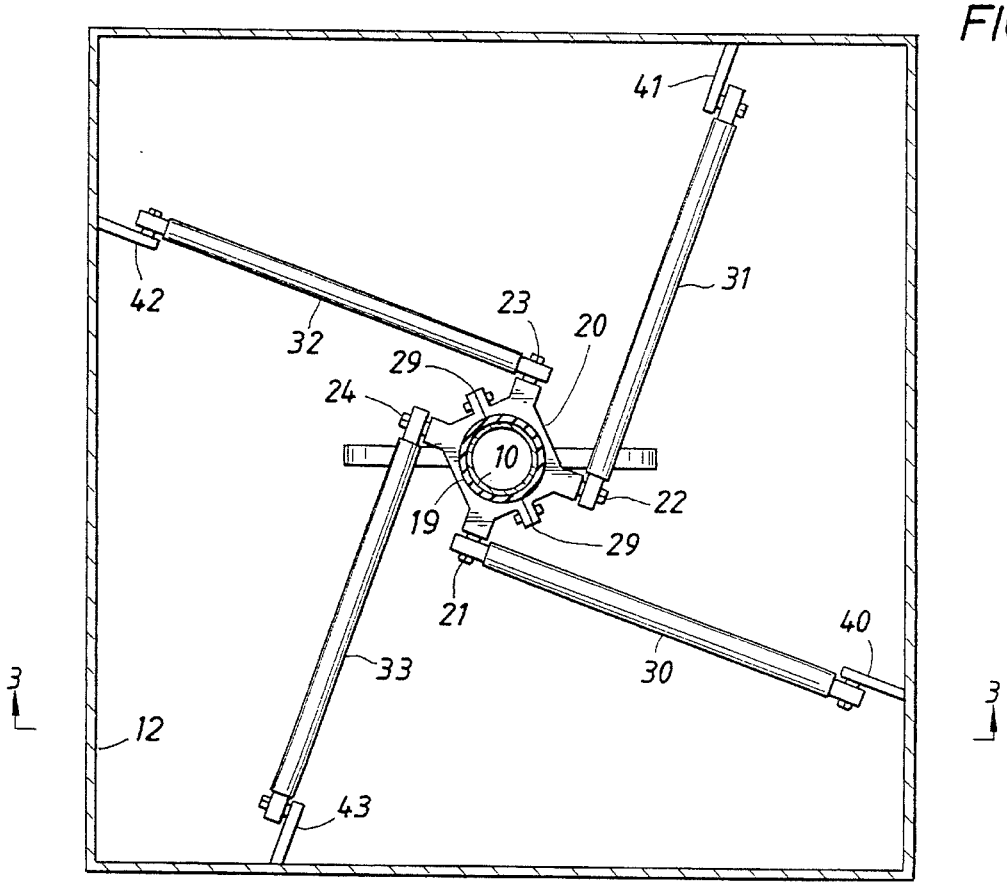
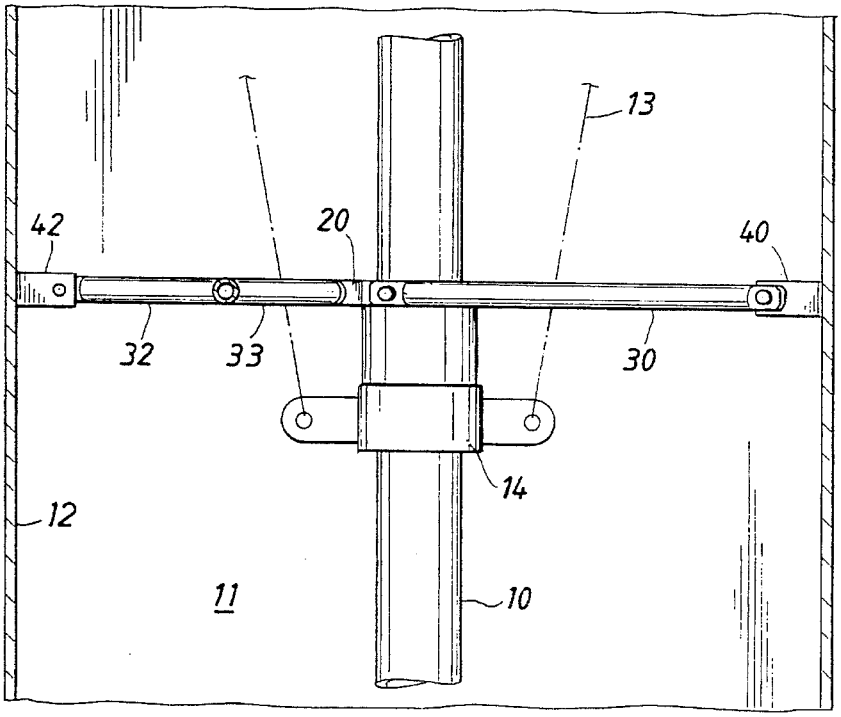
FIG. 3

FIG. 4
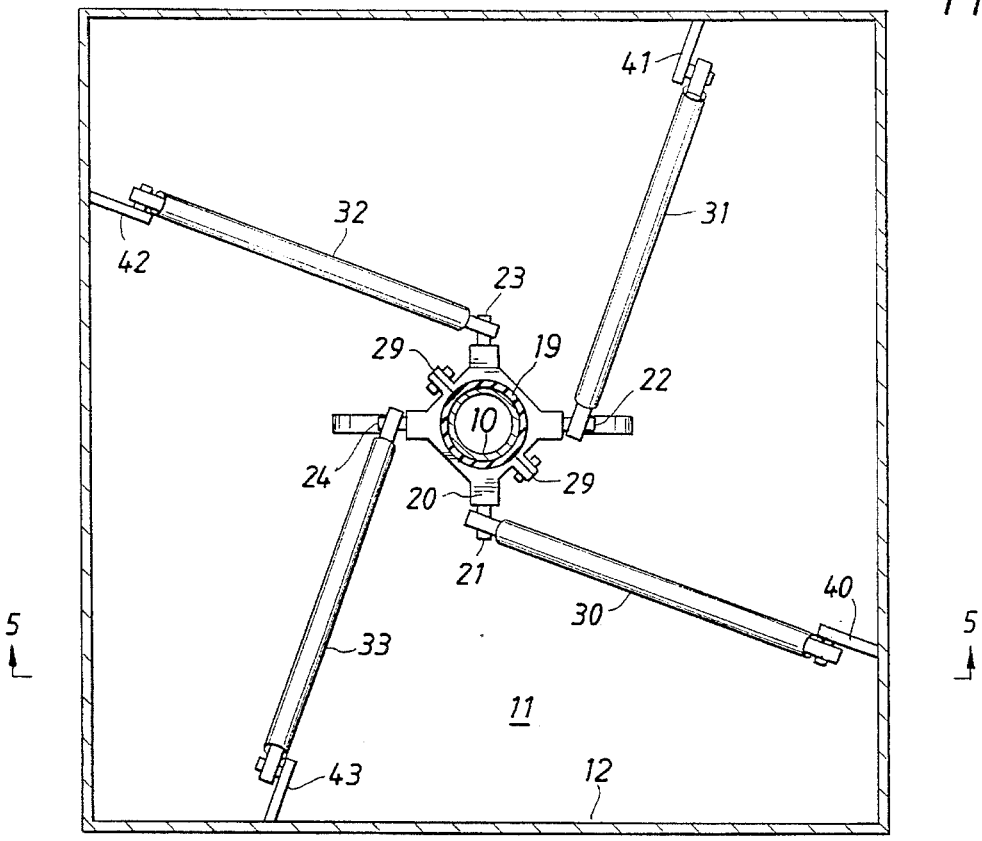
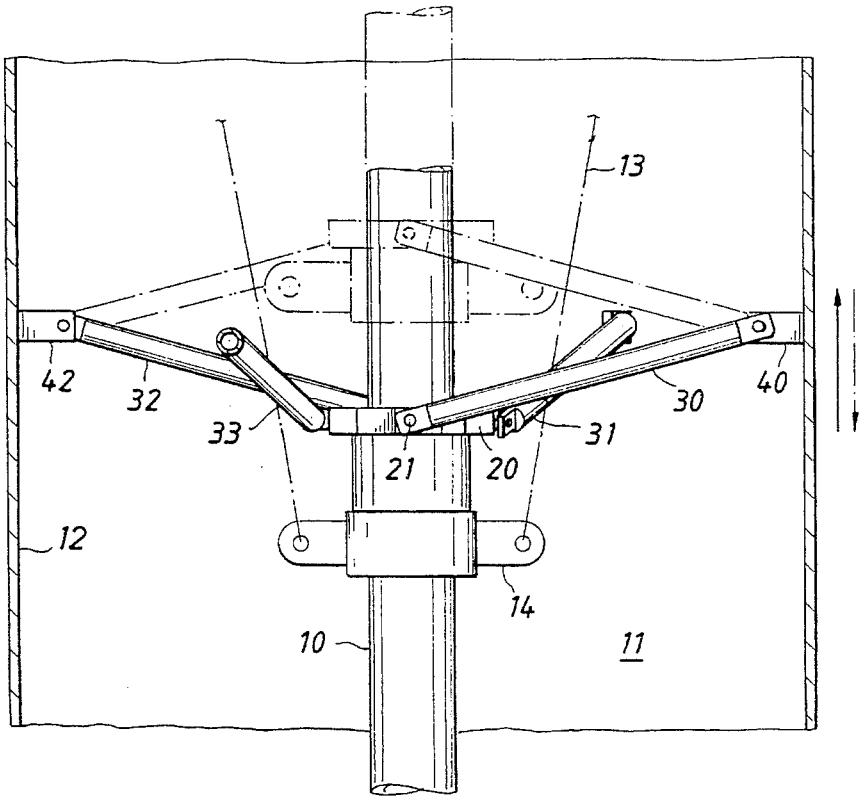
FIG. 5

RISING CENTRALIZING SPIDER

This is a continuation of application Ser. No. 08/252,143, filed Jun. 1, 1994 abandoned which is a continuation of application Ser. No. 07/952,232 filed Sep. 28, 1992.

BACKGROUND OF THE INVENTION

The present invention relates to the drilling of offshore wells and particularly wells that are drilled from a floating drilling rig, i.e., a semisubmersible rig, tension leg platform or similar structure. A floating structure is, of course, subjected to wind and sea conditions that cause the structure to pitch, roll and yaw in response to these forces. When drilling from a floating structure, it is customary to use a marine conductor extending from the structure to the subsea well and held in tension. The drill string extends through the marine conductor and drilling fluid is circulated down the drill string and returns through the annulus between the drill string and conductor. The movement of the floating structure creates several problems since the marine conductor must be maintained both under tension and centered in the drilling rig. The problem of maintaining the tension on the marine conductor is solved by using the various tensioning devices. The marine conductor has been maintained center under the drilling rig by the use of hydraulic cylinders having rollers at the ends. The rollers ride along the outer surface of the marine conductor and maintain the conductor centered under the drill rig in response to movement of the floating vessel.

U.S. Pat. No. 3,528,497 discloses a system for maintaining a marine conductor centered under a drill rig through the use of hydraulic cylinders and rollers which travel along the outer surface of the conductor. The pressure in the hydraulic rams is maintained sufficient to provide the required biasing force to maintain the marine conductor centered as the floating structure moves.

U.S. Pat. No. 3,503,460 shows a similar apparatus in which opposing rams are hydraulically actuated to maintain the conductor centered under the drill rig. The patent discloses the use of pads that are moved toward and away from the conductor to maintain it centered beneath the drill rig in place of the rollers shown in the above 497 patent.

U.S. Pat. No. 3,142,343 discloses a system for centering a conductor in a drill rig in which a ring-shaped member surrounds the conductor. A plurality of springs placed circumferentially around the ring are used for biasing the ring so that it remains centered under the drill rig as the floating drilling vessel moves.

SUMMARY OF THE INVENTION

From the above brief description of the prior art apparatus for maintaining a conductor centered under a drill rig on a floating drilling vessel, it is readily appreciated that they all rely upon a sliding or rolling contact between the centering means and the marine conductor. The marine conductor on a floating drilling vessel moves vertically continuously in response to the tension means as the vessel reacts to the wind and sea conditions. Thus, the sliding contact, be it by pads or rollers between the centering means and the conductor, causes considerable wear on the conductor. Since the vertical movement of the conductor is over a very limited area, this wear is concentrated and causes considerable problems. In attempts to solve this, the conductor has been coated with hard metallic material to provide wear surfaces that do not require continuous maintenance. While this is a partial solution to the problem of wear on the conductor, it is still not a permanent solution and the conductor must either be replaced or the wear surfaces must be repaired at regular intervals.

The present invention solves the above problems by providing a means for centering a marine conductor in the moon pool of a drill rig on a floating drilling vessel that is permanently attached to the marine conductor. The permanent attachment of the centering means to the marine conductor eliminates all movement between the two. The centering means consists of a yoke member which is attached to the marine conductor and travels with it. The yoke member is provided with a spherical bearing so that the outer portion of the yoke can rotate with respect to the marine conductor. A plurality of spider arms are attached at one end to the yoke and the other end to the sidewalls of the moon pool on the drilling vessel. The spider arms are attached using spherical bearings and positioned so that as the marine conductor rises or falls as the drilling vessel reacts to wind and sea conditions, the outer portion of the yoke can rotate and the spider arms will maintain the conductor centered in the moon pool.

The elimination of any sliding or rolling contact between the marine conductor and the centering means eliminates the wear problems that were present in previous devices. While the invention requires the use of spherical bearings, these can be of the type that are formed from a composite of inner-leaved, resilient material such as plastic or rubber and steel plates, which provide limited rotational movement. These types of bearings are available from several sources and do not require any routine service such as lubrication.

BRIEF DESCRIPTION OF THE DRAWINGS

The invention will be more easily understood from the following description when taken in conjunction with the attached drawings in which:

FIG. 2 is a plan view taken along line 2—2 of FIG. 1 drawn to an enlarged scale.

FIG. 3 is an elevation view taken along line 3—3 of FIG. 2.

FIG. 4 is a plan view similar to FIG. 2 with the marine conductor moved to a different position.

FIG. 5 is an elevation view taken along line 5—5 of FIG. 4.

DESCRIPTION OF THE PREFERRED EMBODIMENT

Figure 1:
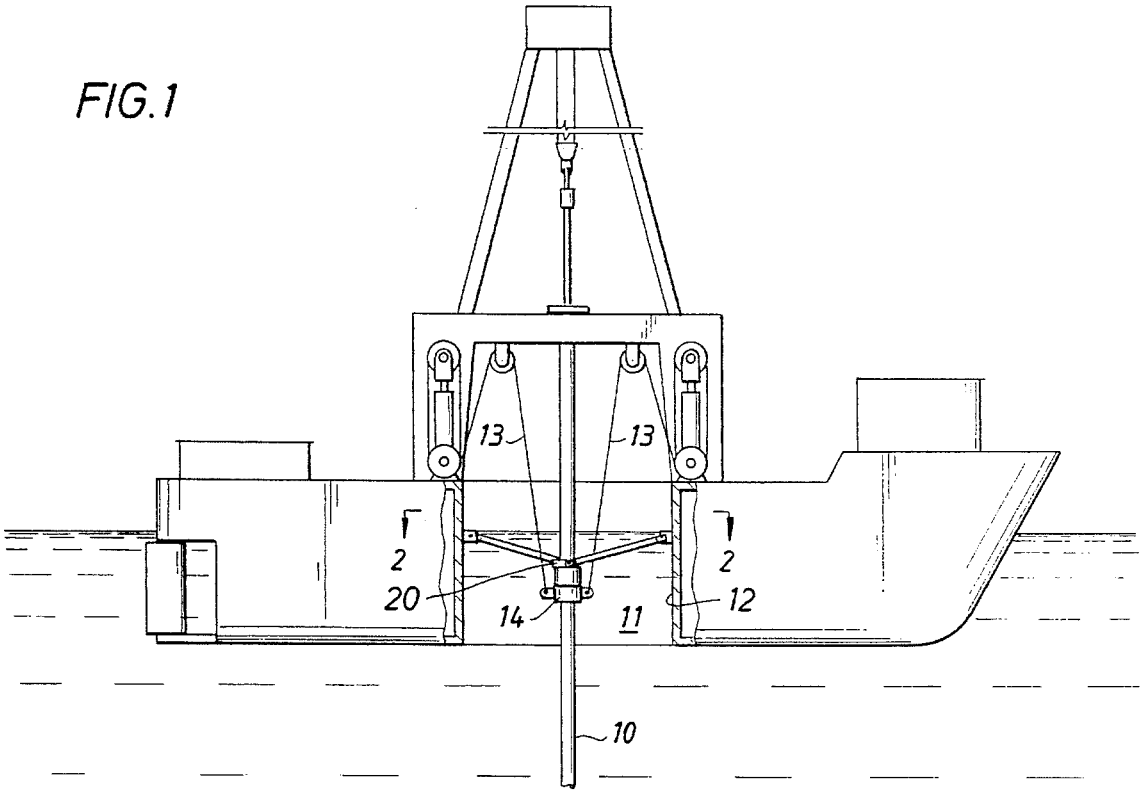
FIG. 1 is an elevation view of a floating drilling vessel showing the invention installed thereon.

Referring to the attached drawings, there is shown a drilling vessel having a marine riser or conductor 10 extending up through a moon pool 11. The marine conductor 10 surrounds the drill pipe (not shown) and the annulus between the marine conductor 10 and the drill pipe is used for conveying the drilling fluid and the drill bit cuttings from the bottom of the borehole back to the drilling vessel. These conductors are usually quite large since the casing which is used for casing the well must be passed through the interior of the marine conductor. Thus, the conductors are normally 16 inches or more in diameter. The marine conductor 10 is maintained under tension to prevent it from buckling or otherwise distorting as the vessel moves in response to wave action by a tensioning means 13. The tensioning means 13 is attached to the marine conductor 10 by clamp means 14 so that the tensioning means 13 can maintain a constant tension on the marine conductor 10.

While the above description refers to a drilling riser, the invention can be used with any riser extending from a floating platform to the ocean floor. For example, the invention can be used with a production riser when it is moved to the center of the moon pool of the platform to perform workover operations on the well. Likewise the invention can be used with export risers when they require centering over the moon pool. Further, while the invention is described as installed in the moon pool, it can be installed at any location on the platform where there is space available for positioning the spider arms described below.

Figure 6:
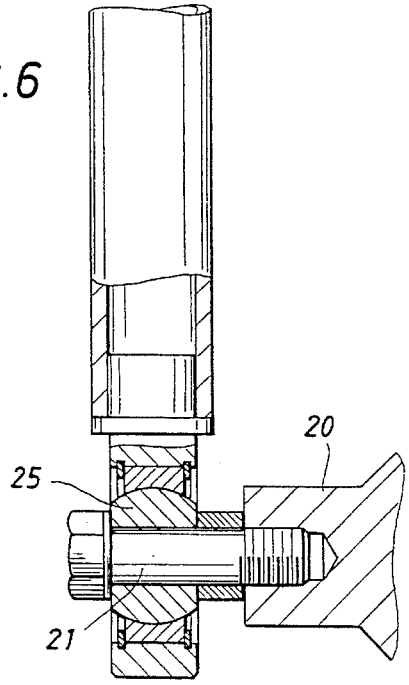
FIGS. 6 and 7 are plan views shown in section of two types of spherical bearings that can be used in the invention.
Figure 7:
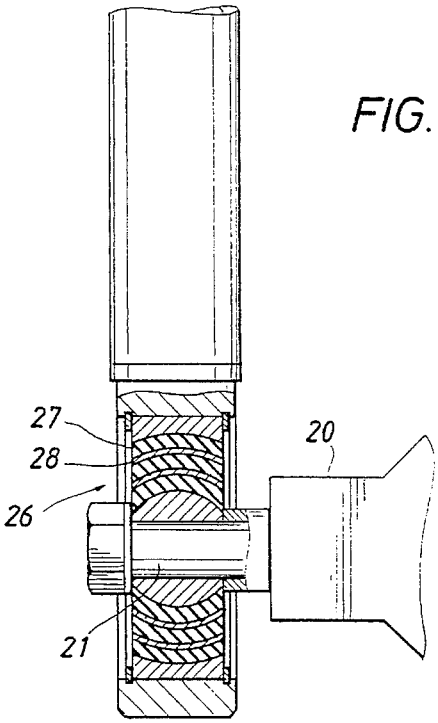

A collar member 20 is secured to the clamp means 14 of the tensioning means 13 so that it tracks the vertical movement of the marine conductor 10. The collar member 20 may be a split or two-piece collar which is clamped to the tensioning means 13 by bolts placed through ears 29 projecting radially from the split collar 20 as shown in the drawings. While the collar 20 can be clamped to the riser it is preferable to provide a bearing means between the collar and the riser. This will permit the collar to rotate as described below without causing the riser to rotate. The bearing is preferably a spherical bearing that, in addition to allowing the collar to rotate, would allow the riser to tilt with respect to the plane of the collar. Rotary bearing 19 is illustrated schematically in FIGS. 2 and 4. The spherical bearing can be of the same type as shown in FIG. 6 and FIG. 7 and described in detail below. The collar 20 is provided with four stud-like projections, 21, 22, 23 and 24. These stud projections provide the mounting means for one end of the spider arms 30, 31, 32 and 33 that are utilized in the present invention. The spider arms are preferably positioned with the axis of rotation of the bearing parallel to the horizontal plane. Normally, the angle of rotation of the collar 20 around the riser 10 will exceed the angle of rotation of the spider arms as a result of vertical movement of the riser. The positioning of the spider arms with the axis of rotation of the bearing parallel to the horizontal plane will ensure that the major rotation of the spherical bearing will be around its normal rotational axis. The limiting of tilt rotation outside of the normal rotational axis allows the use of simpler and lower cost spherical bearings. The inner end of each spider arm is coupled to the end of the stud members by a spherical bearing 25 or 26 as shown in FIGS. 6 and 7. The opposite end of each spider arm is coupled to mounting bracket 40, 41, 42 and 43 that are secured to the walls 12 of the moon pool 11. The spider arms are coupled to the mounting brackets on the walls of the moon pool by spherical bearings 25 or 26. It should be noted that the attachment points between the spider arms and the mounting brackets all lie in a plane that is perpendicular to the normal axis of the conductor.

While the use of four spider arms are described above, three arms can also be used to centralize the riser. Likewise, more than four can be used, but the added complication of additional arms would not improve the operation of the invention. The use of four arms is preferred since it permits the removal of one arm for service without taking the complete unit out of service.

The movement of the spherical bearings is limited to a relatively narrow range and therefore, true spherical bearings which would provide 360-degrees of rotational movement are not required. Thus, spherical bearings 26 shown in FIG. 7 formed from a composite of inner-leaved deformable material 27, such as rubber or plastic, and metallic plates 28 can be used. This type of spherical bearings are used extensively in flex couplings that are utilized in offshore environments for connecting various conductors and pipe-like members to the movable floating platforms. This type of member is supplied by various manufacturers, for example, Oil States Industries Division of LTV Energy Products, located in Arlington, Texas. It is likewise possible to use conventional spherical bearings 25 such as those supplied by various bearing manufacturers.

It should be noted in FIGS. 2 and 4 that the spider arms are not perpendicular to the walls of the moon pool but rather, are set at an angle. All of the spider arms are positioned at the same angle with respect to the wall of the moon pool. This provides the necessary freedom of movement of the spider arms as the marine conductor rises or falls as shown by the dotted lines in FIG. 5 and maintains the marine conductor centered.

Since the spider arms have a fixed length and are pivotally secured at each end, they will cause the collar 20 to rotate as the marine conductor rises and falls in response to movement of the floating structure. The rotation of the collar is clearly shown in FIGS. 2 and 4 wherein spider arms are horizontal in FIG. 2 and inclined at an angle in FIG. 4 in response to vertical movement of the marine conductor as shown in FIG. 5. Rotation of the collar 20 allows the distance between the point at which the spider arms are attached to the walls of the moon pool 11 and the center of the collar to lengthen while the arms remain a fixed length. The configuration of the collar and mounting of the spider arms can be varied to provide the desired vertical movement of the marine conductor.

From the above description it can be appreciated that the present invention provides a centering apparatus that maintains the marine conductor 10 centered in the moon pool 11 without requiring any sliding movement along the conductor. Therefore, wear on the conductor is eliminated and the system will function with a minimum of maintenance. This is especially the case when the spherical bearings are formed from a composite of deformable material such as rubber and steel inner-leaves as used in flexible pipe joints.

What is claimed is:

1. An apparatus for centralizing a riser in an opening in a floating drilling vessel as said riser raises and falls in response to wave and wind forces on the drilling vessel, said apparatus comprising:

a rotary bearing collar adaptable for positioning around the riser and disposed to rotatively follow the vertical movement of the riser; and a plurality of spider arms, one end of each arm being pivotally mounted on said collar and the other end of each arm being pivotally mounted at a fixed position on the portion of the drilling vessel surrounding the opening.

2. An apparatus for centralizing a riser in an opening in a floating drilling vessel as said riser raises and falls in response to wave and wind forces on the drilling vessel, said opening being surrounded by the structure of said drilling vessel, said apparatus comprising:

a collar member disposed to surround the riser a rotary bearing means connecting the collar to the riser;

four mounting means equally spaced around the outer periphery of the collar;

four spherical bearing means, one of said bearing means being disposed on each of said mounting means;

a second set of four spherical bearing means, said second set of spherical bearing means being mounted in fixed positions on the structure of the drilling vessel surrounding said opening, said second set of spherical bearings, in addition, being positioned in a common horizontal plane perpendicular to the axis of the riser; and four spider arms, each of said spider arms being connected at one end to one of the spherical bearing means on said collar member, the other end of each of said spider arms being connected to one of the spherical bearing means mounted on the structure of the drilling vessel surrounding said opening.

3. The apparatus of claim 2 and, in addition, a rotary bearing means, said rotary bearing means being disposed between said collar member and said riser to allow said collar member to rotate about said riser.

4. The apparatus of claim 3 wherein said spherical bearings are formed from a combination of alternate metal and elastomeric layers.

5. The apparatus of claim 2 and, in addition, a tensioning means to maintain said riser under tension and a connecting means for connecting said tensioning means to said riser to maintain the riser under tension as the platform moves; said collar member being disposed to surround said connecting means whereby said collar member follows the vertical movements of the riser with respect to said platform.

6. The apparatus of claim 3 wherein the spherical bearing means on said collar member is disposed to permit rotation between the riser and the collar member about a vertical axis and the spherical bearing means mounted on the structure of the drilling vessel are disposed to permit rotation about an axis of rotation parallel to the horizontal plane.

7. The apparatus of claim 2 and, in addition, a tensioning means, said tensioning means being attached to said riser to maintain said riser under tension.

* * * * *